US008960942B2

(12) United States Patent
Galli et al.

(10) Patent No.: US 8,960,942 B2
(45) Date of Patent: Feb. 24, 2015

(54) WEAPON MOUNTED LIGHT AND OPERATION THEREOF

(75) Inventors: Robert D. Galli, North Kingstown, RI (US); Christopher J. O'Brien, Wakefield, RI (US)

(73) Assignee: Emissive Energy Corporation, North Kingstown, RI (US)

( * ) Notice: Subject to any disclaimer, the term of this patent is extended or adjusted under 35 U.S.C. 154(b) by 0 days.

(21) Appl. No.: 13/309,702

(22) Filed: Dec. 2, 2011

(65) Prior Publication Data

US 2012/0139452 A1 Jun. 7, 2012

Related U.S. Application Data

(60) Provisional application No. 61/418,944, filed on Dec. 2, 2010.

(51) Int. Cl.
*F41G 1/35* (2006.01)
*F41G 11/00* (2006.01)

(52) U.S. Cl.
CPC ..... *F41G 11/004* (2013.01)
USPC ..... 362/110; 362/113; 362/184; 315/313; 315/210; 315/362

(58) Field of Classification Search
USPC ..... 315/313, 210, 362; 362/110, 113, 114, 362/230, 184, 231, 362, 205, 208, 310, 294
See application file for complete search history.

(56) References Cited

U.S. PATENT DOCUMENTS

| | | | | |
|---|---|---|---|---|
| 5,430,967 | A | 7/1995 | Woodman, III et al. | |
| D398,410 | S | 9/1998 | Fell et al. | |
| D548,385 | S | 8/2007 | Sharrah et al. | |
| D567,894 | S | 4/2008 | Sterling et al. | |
| 7,534,975 | B1 * | 5/2009 | Sharrah et al. | 200/600 |
| 7,614,760 | B2 | 11/2009 | Sharrah et al. | |
| D612,970 | S | 3/2010 | Sharrah et al. | |
| 7,731,380 | B2 | 6/2010 | Wu | |
| 7,735,255 | B1 | 6/2010 | Kincaid et al. | |
| D628,323 | S | 11/2010 | Matthews et al. | |
| D628,324 | S | 11/2010 | Matthews et al. | |
| 7,905,624 | B2 | 3/2011 | Bushee et al. | |
| 2007/0240355 | A1 | 10/2007 | Hsu | |
| 2009/0122527 | A1 | 5/2009 | Galli | |
| 2010/0259178 | A1 * | 10/2010 | Kalapodas et al. | 315/210 |
| 2011/0255270 | A1 * | 10/2011 | Gross et al. | 362/110 |

* cited by examiner

*Primary Examiner* — Vibol Tan
(74) *Attorney, Agent, or Firm* — Barlow, Josephs & Holmes, Ltd.

(57) ABSTRACT

A novel flashlight assembly that includes an interface integrated into the housing thereof to facilitate mounting of the flashlight to the dovetail rail on a modern combat weapon. The outer body of the flashlight includes a head mounted to a flashlight body at one end and a tapered tail extending outwardly at the other end of the body. Further, the flashlight includes a clamping interface that is a seamless and integrated feature of the outer housing of the flashlight itself for interfacing the flashlight with a firearm. The operational modes of the flashlight are controlled by a single push button and a selector switch. To facilitate a highly compact design the flashlight employs two circuitry arrangements positioned remote from one another and in communication with one another via a single conductive trace to operate at a first signal frequency or a second signal frequency.

19 Claims, 9 Drawing Sheets

WEAPON MOUNTED LIGHT AND OPERATION THEREOF

CROSS-REFERENCE TO RELATED APPLICATIONS

This application is related to and claims priority from earlier filed U.S. Provisional Patent Application No. 61/418,944, filed Dec. 2, 2010.

BACKGROUND OF THE INVENTION

The present invention relates generally to a multi-function flashlight assembly that is configured in a manner that includes an integrated weapon mounting interface. More specifically, the present invention relates to a compact, high intensity, multi-purpose flashlight assembly that includes a high level of functionality in connection with an integrated weapon mounting interface, thereby making the flashlight capable of being utilized as an accessory for a variety of devices such as standard military style rail type mount, for example.

In the prior art, flashlights for use in military applications have typically been constructed in a standard fashion utilizing a tubular outer housing. As a consequence, in order to facilitate mounting of the flashlight onto other devices, such as military weapons, a relatively large mounting assembly was required. Usually, the prior art mounting assembly that is used in connection with a flashlight having conventional construction includes a heavy gauge band that is wrapped around the entire outer housing of the flashlight. In addition, these bands include projections from at least one side where a large thumbscrew is positioned to allow a user to tighten the band around the flashlight. The difficulty encountered with this construction is that in some cases it creates a greater opportunity for the flashlight and mounting assembly to be caught on clothing or brush while the firearm is being carried, thereby knocking the flashlight out of alignment, dislodging the flashlight from the firearm or damaging the flashlight. Further, the interface between the outer tubular housing and the mounting band leaves the potential that the flashlight may slide or rotate within the band requiring frequent repositioning. While this may be acceptable for a sport type firearm, it is not acceptable for a firearm employed for field use, such as hunting or combat environments where immediate, fully aligned use of the flashlight assembly is required.

Actuation of a flashlight retained in such a manner on the fire arm required a user to press a button at the rear of the flashlight in an axial manner. Such pressure not only contributes to the displacement of the flashlight within the mounting band but also requires a user to move their thumb in an awkward manner to operate the flashlight.

Other difficulties with such flashlights include the fact that they were typically single function devices that had to be exchanged for a different flashlight should the need for an additional function arise, such as for example, in infra-red applications. In these situations, the user must carry several different lighting devices with them so that, as the need arises, the user can exchange lighting devices. In addition, should a flashlight include multi-functional features, often the controls are small and fussy making them difficult to operate in the typical military environment where the user is often wearing gloves. In these applications small buttons, sliders and knobs are nearly impossible to operate in a reliable fashion.

In view of the foregoing disadvantages inherent in the prior art devices, there is a need for an assembly that provides an improved method of compactly and reliably mounting a flashlight onto a firearm. There is a further need for an interfaceable flashlight assembly that is multi-functional, easy to operate and provides an improved engagement method for firearms that has the ability to consistently and quickly engage, and provide accurate alignment, while providing a reduced profile, thereby reducing potential interference with other devices and attachments. There is a further need for a device that provides multi-functionality in an improved flashlight construction that is easier to operate and exhibits a high degree of reliability even in the most rugged environment.

BRIEF SUMMARY OF THE INVENTION

In this regard, the present invention provides for a novel flashlight assembly that includes an interface integrated into the housing thereof to facilitate mounting of the flashlight to the dovetail rail on a modern combat weapon. Generally, the outer body of the flashlight includes a head mounted to a flashlight body at one end and a tapered tail extending outwardly at the other end of the body. Further, the flashlight includes protrusions extending from the side of the body for interfacing the flashlight with a firearm. It is preferable that the outer housing of the flashlight includes such a clamping interface that is a seamless and integrated feature of the outer housing of the flashlight itself.

The operational modes of the flashlight are controlled by a single push button and a selector switch. To facilitate a highly compact design the flashlight employs two circuitry arrangements positioned remote from one another and in communication with one another via a single conductive trace. The push button consists of a single momentary switch while the selector includes a magnet and a Hall Effect sensor that operate together to toggle between an open and closed position. In this manner the selector switch, when moved between an open and closed position, provides a signal to the circuitry at the rear of the flashlight to operate at a first signal frequency or a second signal frequency.

In addition to using a change in frequency to toggle the selection of light sources, the present invention also provides additional operational modes such as high illumination, low illumination and strobe by way of example.

Accordingly, it is an object of the present invention to provide a flashlight having a housing that includes a mounting interface that is integrated into the construction of its housing that provides an improved method of compactly and reliably mounting a flashlight onto a firearm. It is a further object of the present invention to provide an interfaceable flashlight assembly that is multi-functional, easy to operate and provides an improved engagement method for firearms that has the ability to consistently and quickly engage, and provide accurate alignment, while providing a reduced profile, thereby reducing potential interference with other devices and attachments. It is still a further object of the present invention to provide a device that provides multi-functionality in an improved flashlight construction that is easier to operate and exhibits a high degree of reliability even in the most rugged environment.

BRIEF DESCRIPTION OF THE DRAWINGS

In the drawings which illustrate the best mode presently contemplated for carrying out the present invention.

DETAILED DESCRIPTION OF THE INVENTION

Figure 1:
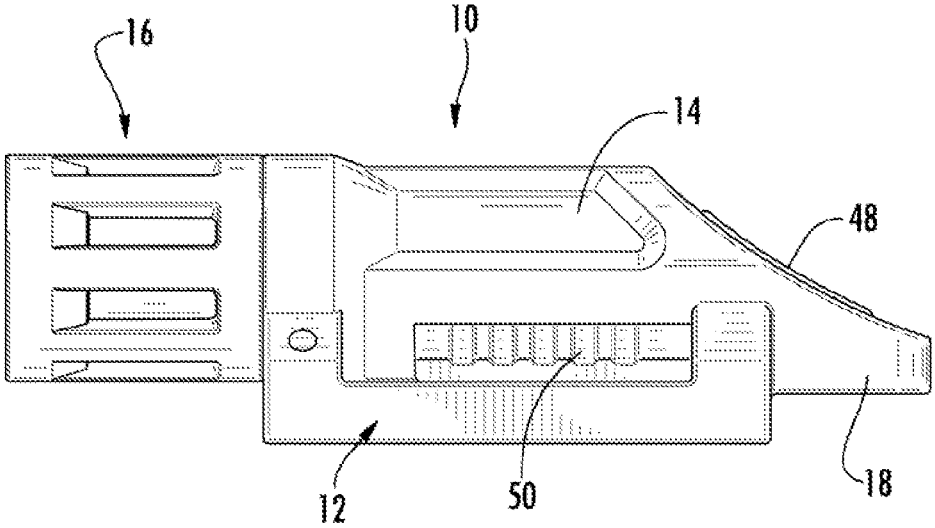
FIG. 1 is a side view of the flashlight assembly of the present invention.
Figure 2:
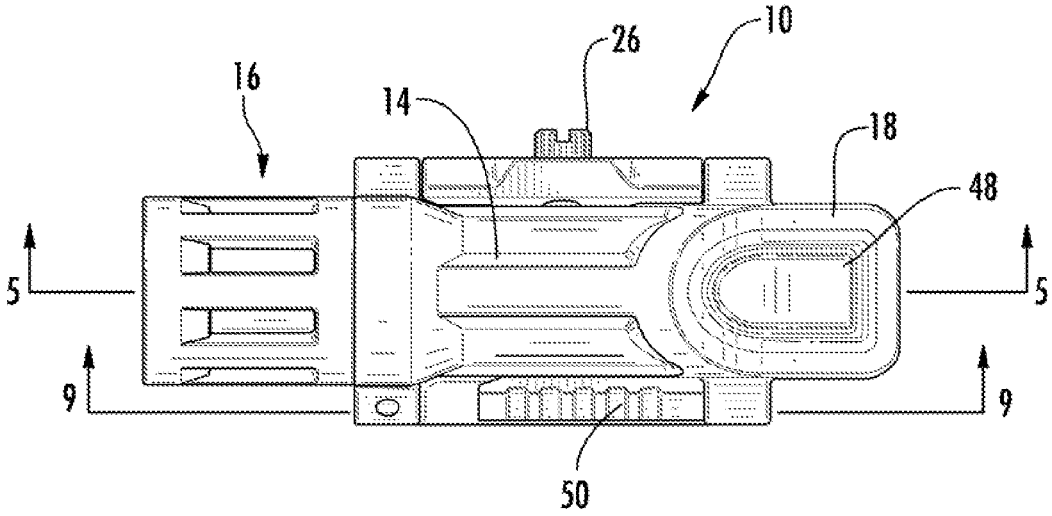
FIG. 2 is a top view of the flashlight assembly of the present invention.

Now referring to the drawings, a flashlight assembly is shown and generally illustrated in the figures. As can be seen in FIGS. 1 and 2, the flashlight assembly 10 includes an interface 12 integrated into the housing 14 thereof to facilitate mounting of the flashlight 10 to the dovetail rail on a modern combat weapon. Generally, the outer body of the flashlight includes a head 16 mounted to a flashlight housing body at one end and a tapered tail 18 extending outwardly at the other end of the body. Further, the flashlight 10 includes protrusions extending from the side of the body that serve as an integrated interface 12 for interfacing the flashlight 10 with a firearm.

Figure 3:
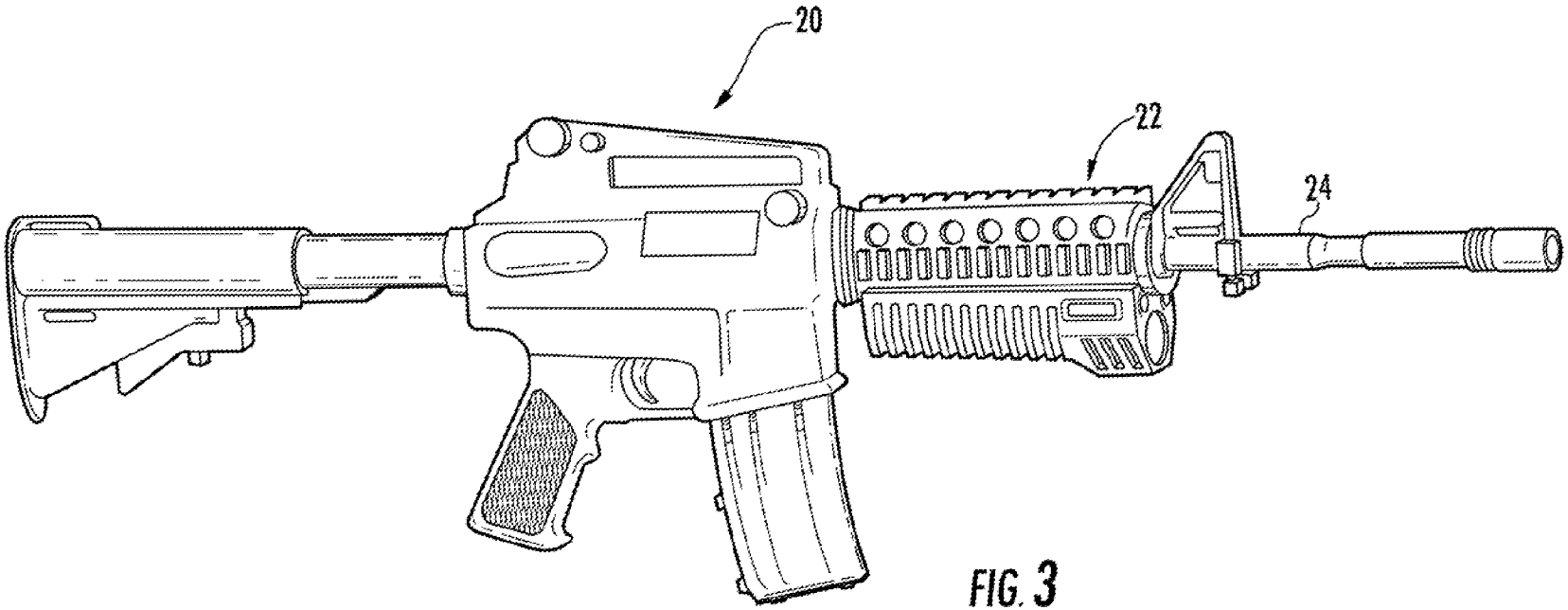
FIG. 3 (PRIOR ART)
FIG. 3 is a prior art combat firearm.

As depicted at FIG. 3, modern type firearms 20 generally include an interface rail integrated 22 thereon for the mounting of auxiliary devices. Additionally, there are several supplemental rail systems that mount onto such firearms 20 and extending along and around the barrel 24 to provide additional interface rails 22 both along the top of the firearm 20 as well as at the 3, 6 and 9 o'clock positions around the barrel 24. All of the interface rails 22 are provided having a standardized profile and are configured specifically for the mounting of various accessories depending on the type environment in which the firearm will be used. The outer housing of the flashlight 10 includes such a clamping interface 12 that is a seamless and integrated feature of the outer housing of the flashlight itself.

Figure 4:
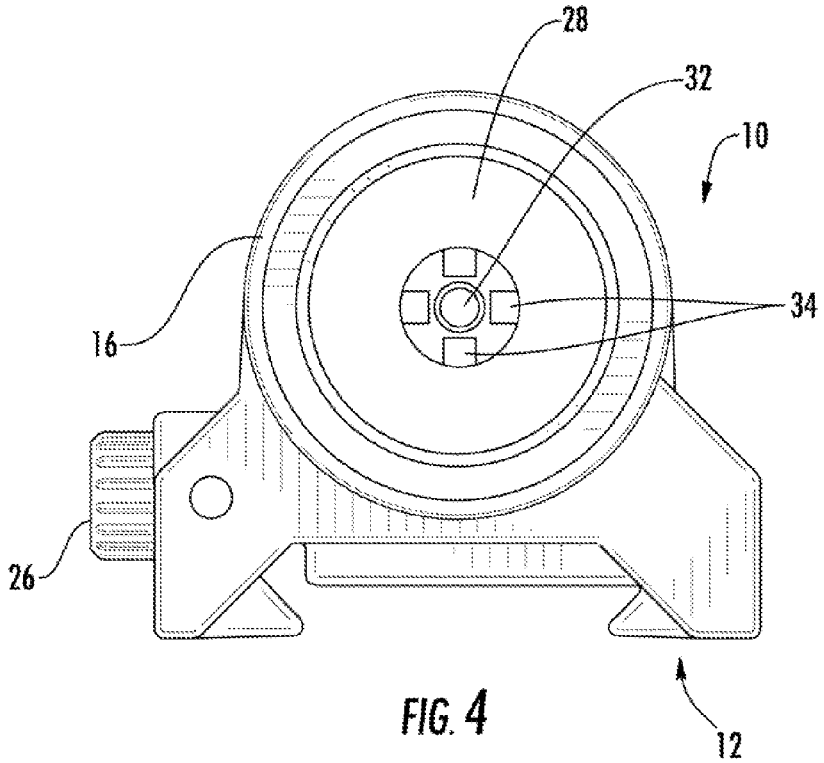
FIG. 4 is a front view of the flashlight assembly of the present invention.

As can be seen at FIG. 4, when the flashlight assembly 10 is mounted onto a firearm the lower portion of the clamping interface 12 is a dovetail that may be formed as a rigid profile that is simply slid onto the firearm accessory rail and retained in place using setscrews. In the alternative, the dovetail interface 12 may be formed as a clamping assembly to engage the accessory rail on the firearm. In this configuration, the mounting interface 12 may include a single tightening mechanism that engages both the second clamping arm that engages the flashlight and the rail interface clamp at the same time. Similarly, the mounting interface may have a separate dedicated clamping member for the dovetail interface. The tightening mechanism for both the clamping arm and the dovetail interface may be set screws, thumb screws, quick release type mechanisms, spring loaded clamps or combinations thereof to allow easy mounting and demounting of the flashlight relative to the firearm. Further, a locking mechanism may be provided that serves to prevent accidental disengagement of the flashlight from the rail. In this embodiment such a lock is shown as a screw 26 that extends when rotated to prevent movement of the clamp.

Figure 5:
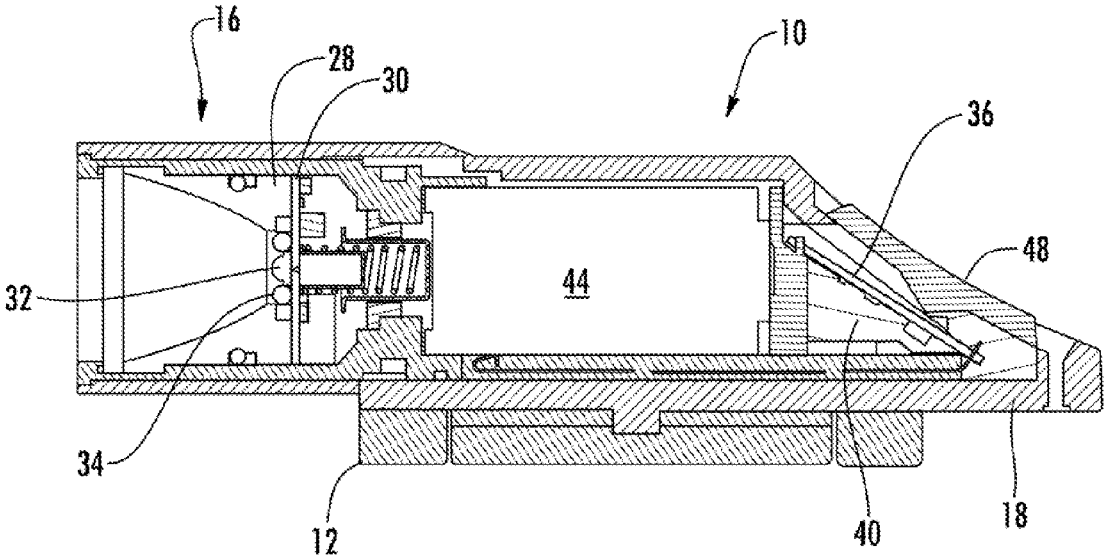
FIG. 5 is a cross-sectional view taken along the line 5-5 of FIG. 2.
Figure 6:
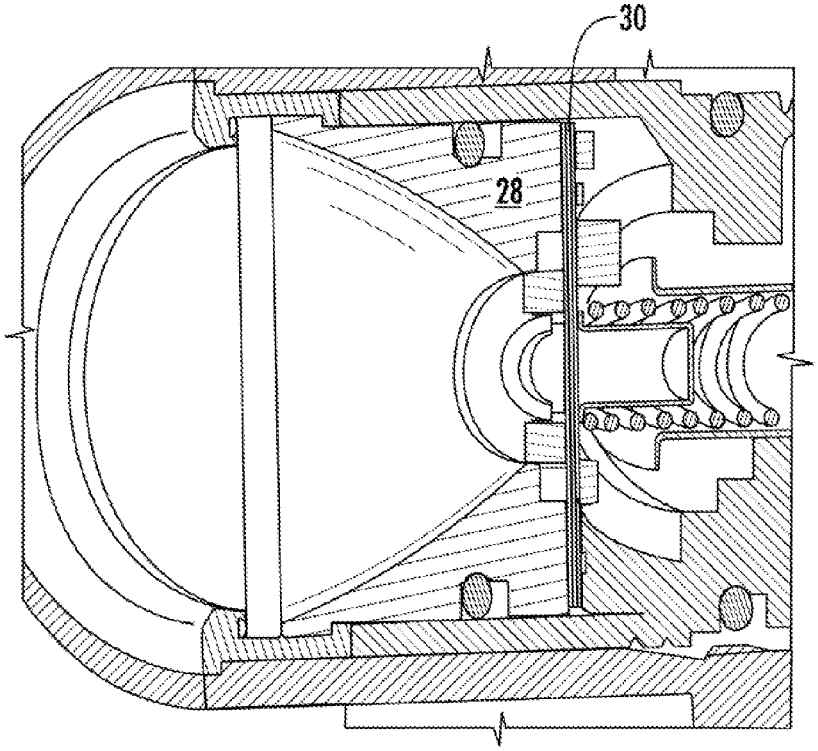
FIGS. 6 and 6*a* are cross-sectional views of the flashlight head portion.
Figure 7:
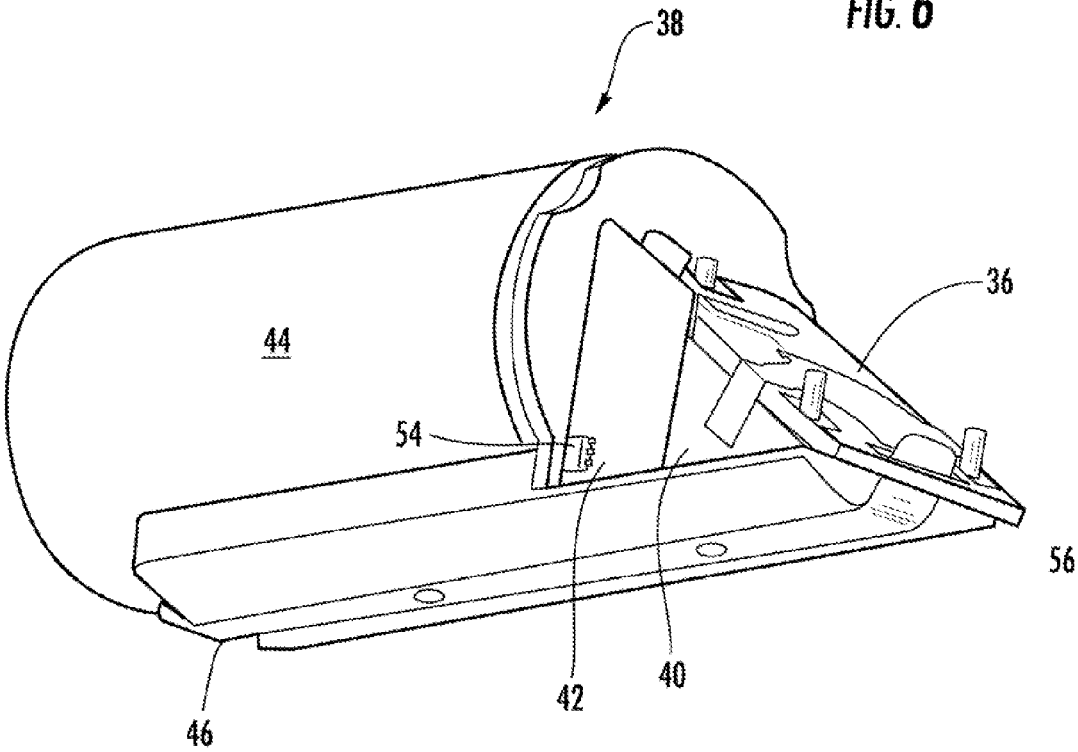
FIG. 7 is a perspective view of the internal cartridge of the flashlight.
Figure 6A:
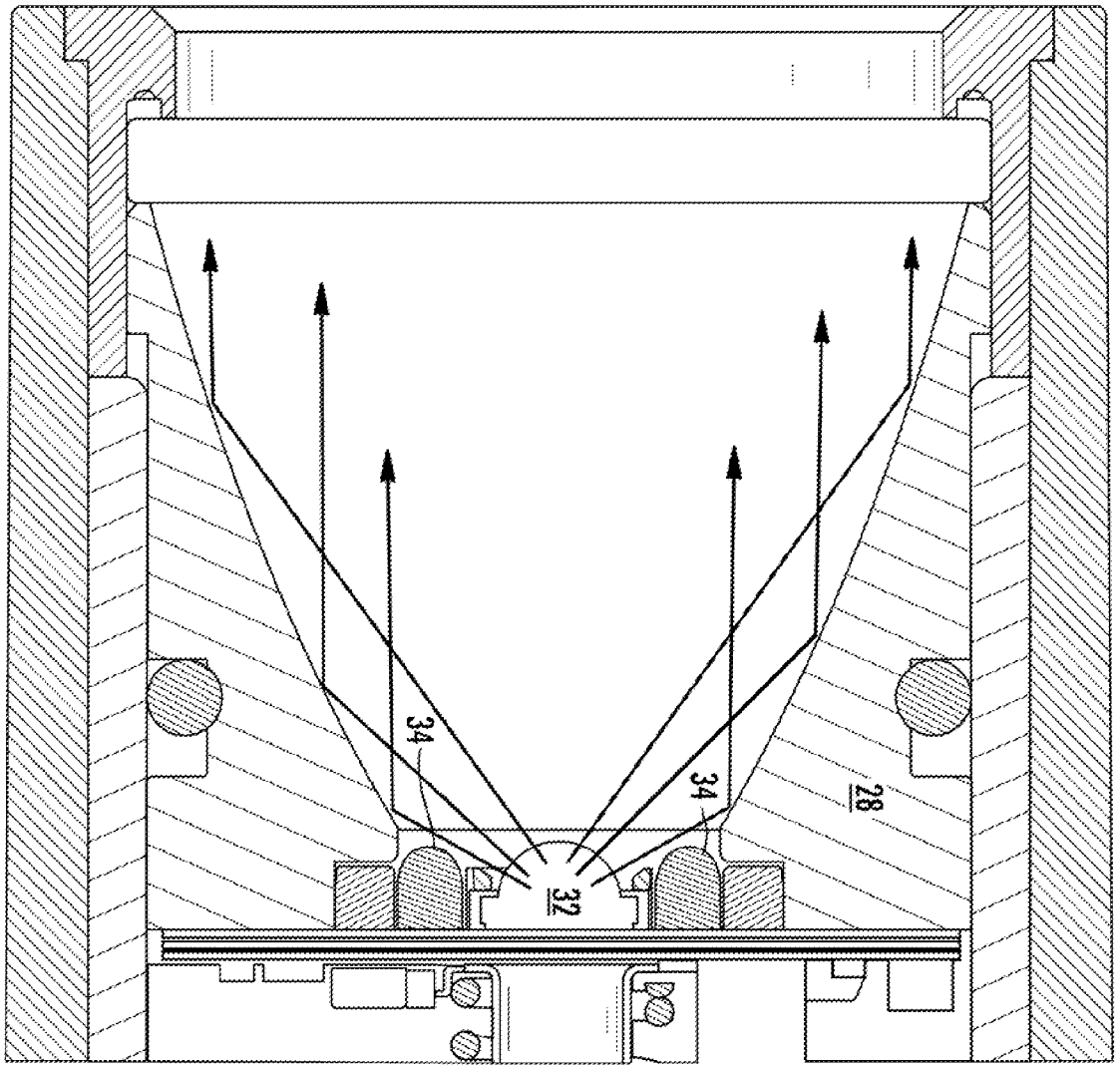
Figure 8:
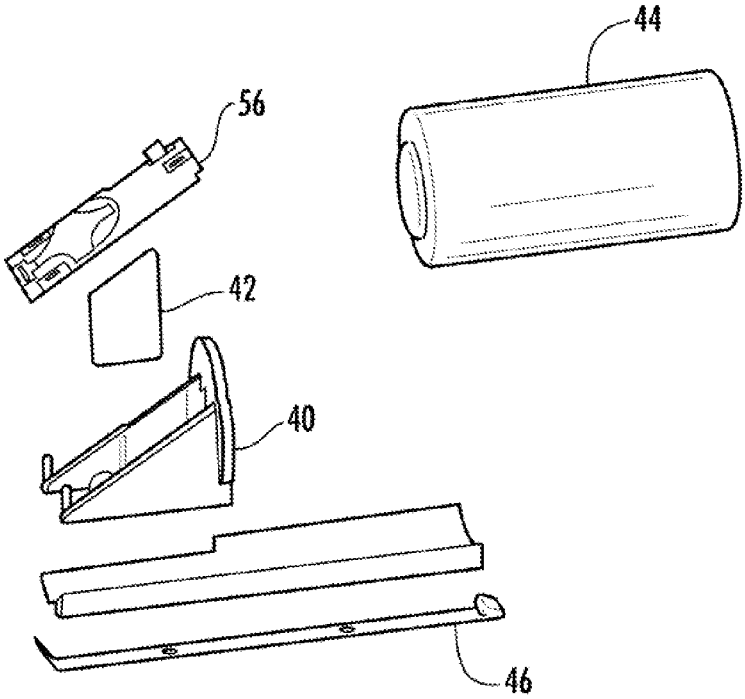
FIG. 8 is an exploded perspective view of the internal cartridge of the flashlight.

Turning to FIGS. 4-6, within the head portion 16 there is a composite heat sink/reflector assembly 28 to collect and dissipate the waste heat generated during operation of the flashlight. Adjacent a rear surface of the heat sink is positioned a circuit board 30 that includes an array of at least two LEDs positioned thereon. In the preferred embodiment the LEDs include a visible white LED 32 positioned centrally within the reflector and one or more infra-red LEDs 34 positioned adjacent the white LED 32 and at the periphery of the opening in the reflector 28. This arrangement facilitates the use of a dual operational mode such that the output of the LEDs are maximized regardless of the mode in which the flashlight is being operated. In the prior art, vias were created within the surface of the reflector to allow light from ancillary LEDs to emit through the same lens as the light from the primary LED. However, in such an arrangement, the vias created an interruption in the surface of the reflector, causing dark spots in the light output of the primary LED. In the arrangement of the present invention the white LED 32 is positioned such that all of the light emitted therefrom passes above the level of the front of the ancillary LEDs 34 and is captured and projected forward by the reflector (see FIG. 6*a*). The output from the ancillary infra-red LEDs is captured by the optic on each of the infra-red LEDs 34 themselves and is directed forward in a relatively narrow beam such that the output does not impinge on either the white LED 32 or the reflector 28 surface. It should be appreciated that while in this description the ancillary LEDs 34 are referred to as being infra-red and the primary LED 32 is described as being white, such a description is for illustration purposes and description of a preferred embodiment. It should be understood by one skilled in the art that any arrangement and variation of LEDs and colors could be substituted for the white and infra-red color scheme and still fall within the scope of the present disclosure.

As can best be seen in FIGS. 5-8, a cross section of the flashlight of the present invention is shown. Within the rear portion of the flashlight there can be seen to be a switching mechanism 36 positioned and supported at tapered angle relative to the central longitudinal axis of the flashlight for selective operation of the flashlight. Generally, the internal operational components of the flashlight are contained and supported on a cartridge insert 38 (shown at FIG. 7) that holds and supports the switching mechanism 36 on an angled die cast platform 40, a sensor circuit 42 to switch operational modes of the flashlight as will be described in detail below, a power source 44 contained within the rear portion of the light and an electrically conductive strap 46 to carry modulated power and an operational signal to the flashlight head for operation thereof.

The operational modes of the flashlight are controlled by a single push button 48 and a selector switch 50. To facilitate a highly compact design the flashlight employs two circuitry arrangements positioned remote from one another and in communication with one another via a single conductive strap 46. The push button 48 consists of a single momentary switch while the selector 50 includes a magnet and a Hall Effect sensor 54 that operate together to toggle between an open and closed position. In this manner the selector switch 50, when moved between an open and closed position, provides a signal to the circuitry at the rear of the flashlight to instruct the flashlight to operate at a first signal frequency or a second signal frequency. That frequency is transmitted from the first circuit board 56, along the single conductive strap 46, along with modulated power to the second circuit board 30 at the head of the flashlight. When the circuit board 30 at the head of the flashlight receives the first frequency signal it operates by illuminating the white LED in accordance with the operational instructions. Similarly, when the circuit board 30 at the head of the flashlight receives the second frequency signal it operates by illuminating the infra-red LEDs in accordance with the operating instructions. It is of note that when moving the selector switch 50 the flashlight includes an instruction to power off the LEDs until a new operating instruction is received from the push button. This prevents the accidental switching from infra-red to visible white light simply by bumping the selector switch while the flashlight is in an on mode.

In addition to using a change in frequency to toggle the selection of light sources, the present invention also provides additional operational modes such as high illumination, low illumination and strobe by way of example. These modes are known in the art and do not require further illustration herein. However, many users have a preference as to the manner in which the various operational modes are presented or arranged. For example, some users do not want a strobe function. The present invention allows the toggling on or off of various modes to allow customization of the flashlight operational modes. For example, if the user places the flashlight into strobe mode and then fully de-powers the light (by partially removing the flashlight head), holding the rear push button as the light is powered up will cause the strobe mode to be dropped from the operational modes menu. If the flashlight is again fully de-powered and the push button is held while the light is powered up, strobe functionality will again be toggled on. Similarly, other functions may be toggled on or off or their operation reversed such as making high or low illumination the first menu selection.

Figure 9:
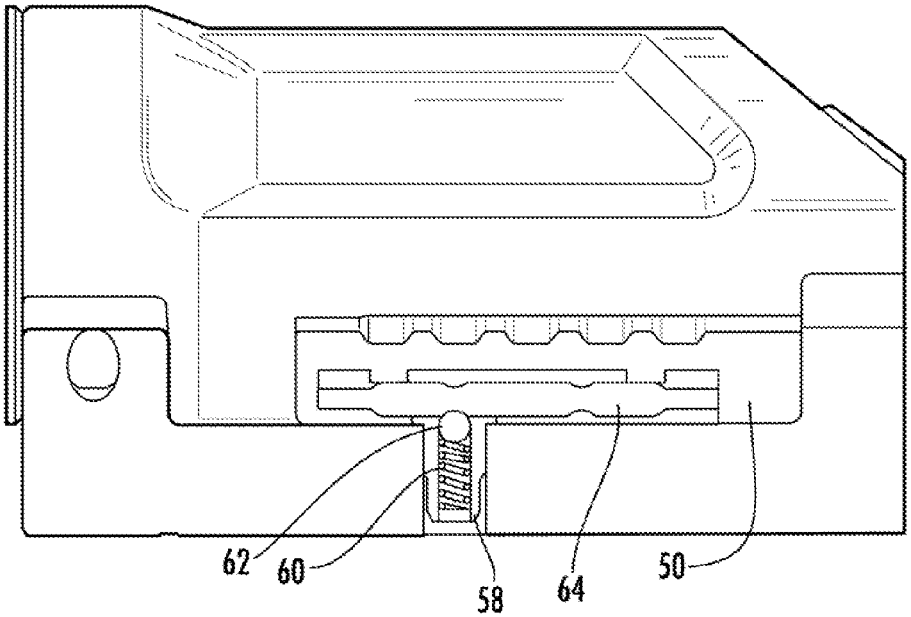
FIG. 9 is a cross-sectional view taken along the line 9-9 of FIG. 2.

As illustrated at FIG. 9, there is a novel manner for the attachment for a selector switch 50 illustrated here as a slide switch used for toggling of the illumination mode of the flashlight. A pin 58 is provided that is mounted into the flashlight perpendicular to the direction of the slide switch motion. The pin 58 has an opening positioned axially therein to receive a spring 60 and ball detent 62. Further the pin 58 includes an opening into which a slide pin 64 is received. The slide pin 64 has detents formed in the outer surface thereof to interact with the ball detent 62 such that at least two positions of the slide pin 58 provide tactile location feedback when the ball 62 engages the detents in the outer surface thereof. A cover is then installed over the slide pin to create an actuator surface for the slide switch 50. In this arrangement all of the wearing surfaces can be formed of metal yet all of the operational forces of the ball detent arrangement are contained so that they only transfer to the slide pin preventing wear of the switch.

Figure 10:
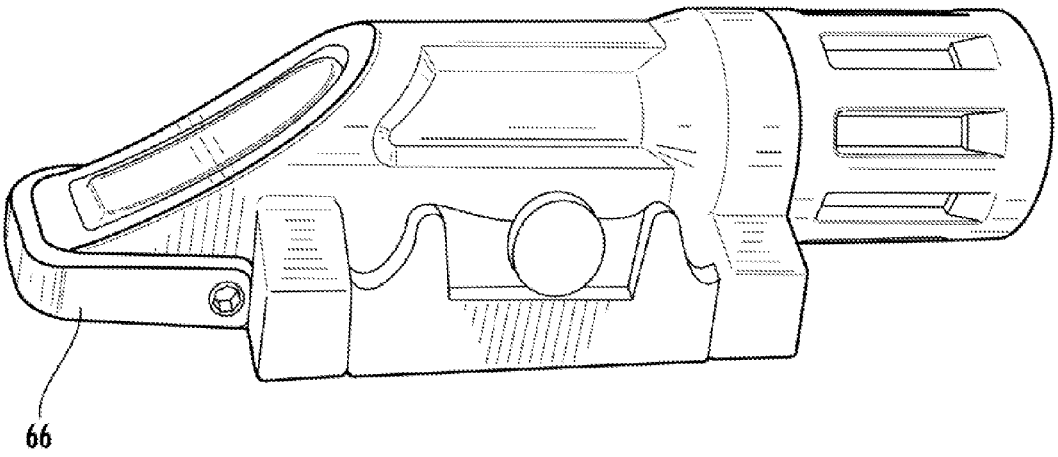
FIG. 10 is a side view of the flashlight assembly of the present invention with a safety feature disengaged.

Turning now to FIGS. 9 and 10, a safety feature is provided in the form of a bail that is movable between a clear position, illustrated at FIG. 9 and a blocking position, illustrated at FIG. 10. When rotated up into the blocking position, the bail prevents the momentary switch from being accidentally depressed thereby preventing the flashlight from accidentally being energized. When the user wishes to operate the flashlight, the bail can easily be rotated to the clear position to allow normal operation of the flashlight.

Figure 11:
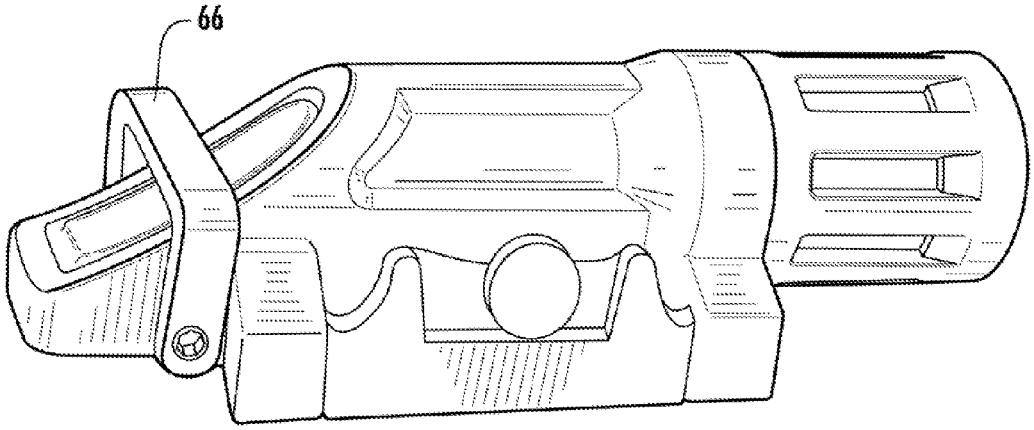
FIG. 11 is a side view of the flashlight assembly of the present invention with a safety feature engaged.
Figure 12:
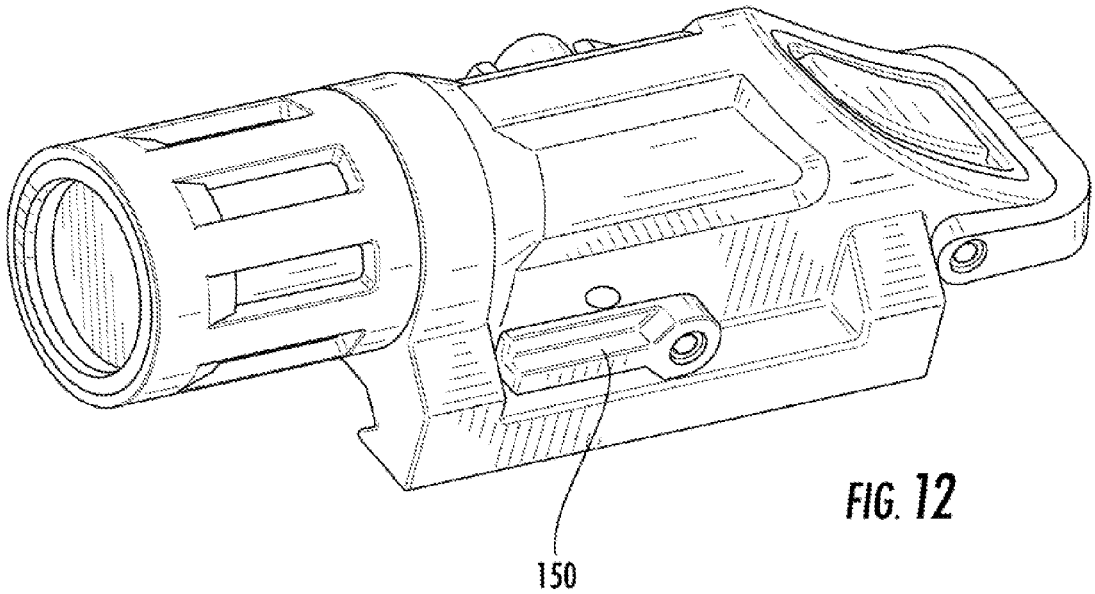
FIG. 12 is a side view of an alternate embodiment of the flashlight assembly of the present invention with a selector in the white mode.

As can be seen in FIGS. 11 and 12 an alternate arrangement for a selector switch 150 is shown. In this embodiment, a rotating lever is used instead of a slide switch and also includes a magnet and a Hall Effect sensor that operate together to toggle between an open (depicted at FIG. 11) and closed position (depicted at FIG. 12). In this manner the lever switch 150, when moved between an open and closed position, provides a signal to the circuitry at the rear of the flashlight to operate at a first signal frequency or a second signal frequency. That frequency is transmitted from the first circuit board, along the single circuit trace, along with modulated power to the second circuit board at the head of the flashlight. When the circuit board at the head of the flashlight receives the first frequency signal it operates by illuminating the white LED in accordance with the operational instructions. Similarly, when the circuit board at the head of the flashlight receives the second frequency signal it operates by illuminating the infra-red LEDs in accordance with the operating instructions.

Figure 13:
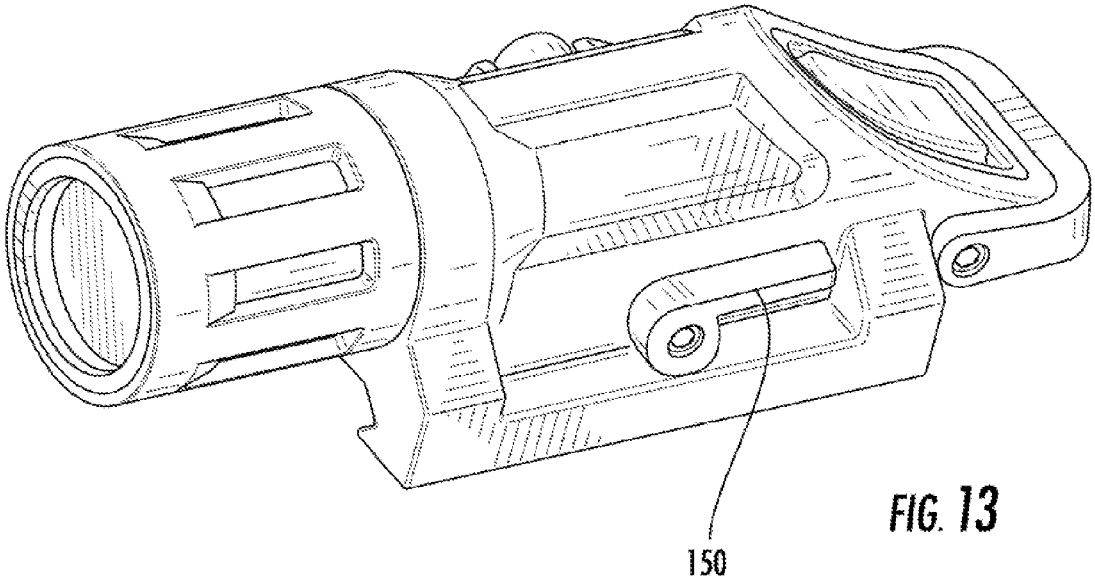
FIG. 13 is a side view of an alternate embodiment of the flashlight assembly of the present invention with a selector in the IR mode.
Figure 14:
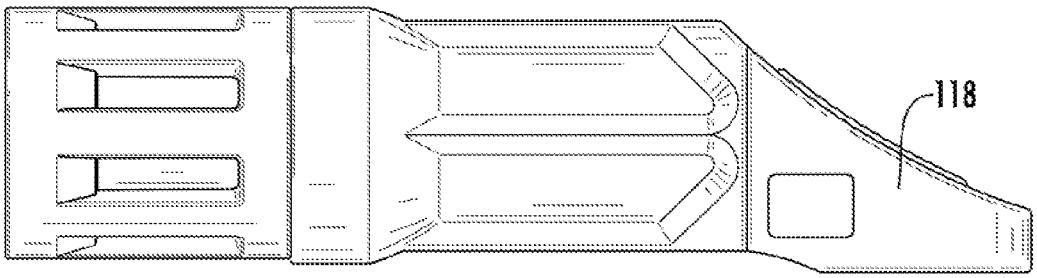
FIG. 14 is an alternate embodiment of the present invention wherein an operational switch is shown as a retrofit for an existing weapon mounted flashlight.

In another alternate arrangement of the present invention, the push button in the ergonomic arrangement of the present invention is provided at FIG. 13 as a retrofit attachment 118 for an existing weapon mounted flashlight. The details and manner in which the retrofit switch 118 affixes to the existing light will vary from model to model depending on the particular construction of the light being retrofit. However, the present invention provides for a push button operator on an existing light to be removed and exchanged for an operator that is ergonomically shaped as has been discussed herein.

Accordingly, it can be seen that the present invention provides a flashlight having a housing that includes a mounting interface that is integrated into the construction of its housing that provides an improved method of compactly and reliably mounting a flashlight onto a firearm that is multi-functional, easy to operate and provides an improved engagement method for firearms that has the ability to consistently and quickly engage, and provide accurate alignment, while providing a reduced profile, thereby reducing potential interference with other devices and attachments. It can be further seem that the present invention provides a device that includes multi-functionality in an improved flashlight construction that is easier to operate and exhibits a high degree of reliability even in the most rugged environment. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A multi-function flashlight comprising:

a first circuit including a first light source and a second light source;

a second circuit including a selector switch movable between a first position for selecting a first operating mode wherein said first light source is illuminated and a second position for selecting a second operating mode wherein said second light source is illuminated and further including a switch for energizing said first and second circuits; and an electrical conductor extending between said first and second circuits, said first and second circuits being operable to communicate through said electrical conductor at first and second signal frequencies corresponding to first and second operating modes, said flashlight being operable in said first operating mode when said selector switch is in a first position whereby said second circuit sends an operating signal to said first circuit at a first signal frequency when said selector switch is in said first position, and said flashlight being operable in a second operating mode when said selector switch is in a second position whereby said second circuit sends an operating signal to said first circuit at a second signal frequency when said selector switch is in said second position.

2. The multi-function flashlight of claim 1 where the selector switch is a slide switch.

3. The multi-function flashlight of claim 1 where the selector switch is a lever.

4. A multi-function flashlight comprising:

at least two light sources;

a selector switch for selecting a mode; and a switch for energizing one of said at least two light sources based on the mode selected by the selector switch, wherein the selector switch includes a magnet therein, said magnet opening a Hall Effect sensor when said selector switch is positioned in a first position and closing said Hall Effect sensor to close when said selector is in a second position.

5. The multi-function flashlight of claim 1 further comprising:

a housing having an integrated interface for attachment to a firearm.

6. The multi-function flashlight of claim 5 further comprising:

an interface lock to prevent accidental disengagement of said interface from said firearm.

7. The multi-function flashlight of claim 6 wherein the interface is a clamp and the interface lock is a screw that when engaged prevents opening of said clamp.

8. A multi-function flashlight comprising:

a primary light source;

a secondary light source, said primary light source and said secondary light source being disposed adjacent one another on a substrate; and a reflector having an aperture therein, said primary and secondary light sources being received within said aperture, wherein said primary light source is positioned such that output therefrom passes above a front surface of the secondary light source, and is captured and projected forward by a surface of said reflector, and wherein output from said secondary light source is directed forward such that the output does not impinge on the reflector surface.

9. The multi-function flashlight of claim 8, wherein said reflector is a heat sink.

10. The multi-function flashlight of claim 8, wherein said primary light source is centrally located within said aperture, and said secondary light source is located on a periphery of said aperture.

11. The multi-function flashlight of claim 10, wherein said secondary light source comprises a plurality of secondary light sources concentrically located around said primary light source on a periphery of said aperture.

12. The multi-function flashlight of claim 8, further comprising a selector switch for selecting a mode of operation of said primary and secondary light sources, and a switch for energizing at least one of said primary and secondary lights sources based a mode of operation indicated by said selector switch.

13. The multi-function flashlight of claim 1, wherein the selector switch includes a magnet therein, said magnet opening a Hall Effect sensor in said second circuit to indicate a first operating mode when said selector switch is positioned in a first position and closing said Hall Effect sensor to indicate a second operating mode when said selector is in a second position.

14. A multi-function flashlight comprising:

a first circuit including a light source;

a second circuit including a selector switch movable between a first position for selecting a first operating mode and a second position for selecting a second operating mode, said second circuit further including a switch for energizing said first and second circuits; and an electrical conductor extending between said first and second circuit, said first and second circuits being operable to communicate through said electrical conductor at first and second signal frequencies corresponding to first and second operating modes, said flashlight being operable in said first operating mode when said selector switch is in a first position whereby said second circuit sends an operating signal to said first circuit at a first signal frequency when said selector switch is in said first position, and said flashlight being operable in a second operating mode when said selector switch is in a second position whereby said second circuit sends an operating signal to said first circuit at a second signal frequency when said selector switch is in said second position.

15. The multi-function flashlight of claim 14 where the selector switch is a slide switch.

16. The multi-function flashlight of claim 14 where the selector switch is a lever.

17. The multi-function flashlight of claim 14 further comprising:

a housing having an integrated interface for attachment to a firearm.

18. The multi-function flashlight of claim 17 further comprising:

an interface lock to prevent accidental disengagement of said interface from said firearm.

19. The multi-function flashlight of claim 18 wherein the interface is a clamp and the interface lock is a screw that when engaged prevents opening of said clamp.

* * * * *